US006182720B1

(12) United States Patent
Barnoski et al.

(10) Patent No.: US 6,182,720 B1
(45) Date of Patent: Feb. 6, 2001

(54) QUICK CONNECTING VERTICAL CONNECTOR

(76) Inventors: Robert Barnoski; Jillian Lee Barnoski; Christine Lynn Barnoski, all of 80 Granville Rd., North Granby, CT (US) 06060

( * ) Notice: Under 35 U.S.C. 154(b), the term of this patent shall be extended for 0 days.

(21) Appl. No.: 09/470,853

(22) Filed: Dec. 23, 1999

(51) Int. Cl.[7] ..... B65B 1/04
(52) U.S. Cl. ..... 141/375; 141/364
(58) Field of Search ..... 141/363–375, 141/331, 339

(56) References Cited

U.S. PATENT DOCUMENTS

| | | | | |
|---|---|---|---|---|
| 2,767,744 | | 10/1956 | Beerman | 141/319 |
| 3,620,267 | | 11/1971 | Seablom | 141/364 |
| 3,877,499 | | 4/1975 | Fluster | 141/310 |
| 3,963,063 | | 6/1976 | Pascarella | 141/309 |
| 4,201,525 | | 5/1980 | Noel | 141/286 |
| 4,347,879 | * | 9/1982 | Blaser | 141/364 |
| 5,533,553 | * | 7/1996 | Vesborg | 141/364 |
| 5,950,698 | * | 9/1999 | Cristea et al. | 141/364 |

* cited by examiner

*Primary Examiner*—Steven O. Douglas
(74) *Attorney, Agent, or Firm*—Perman & Green, LLP

(57) ABSTRACT

The invention resides in fluid transfer device having an inverted funnel at its top and a conically downwardly tapered funnel at its bottom with a collecting portion formed about generally its midspan. The upper inverted funnel has a longitudinal slot formed therewithin and an opening is formed in the collecting portion allowing fluid to pass between the upper container and the lowermost container and the slot allows the upper inverted funnel to be circumferentially compressed against the interior surface of a container so as to act as a fluid conduit therebetween.

17 Claims, 4 Drawing Sheets

QUICK CONNECTING VERTICAL CONNECTOR

BACKGROUND OF THE INVENTION

Field of the Invention

The present invention relates to a coupling device for transferring viscous fluids, from one bottle to another, and relates more particularly, to an improvement in such a coupling device whereby the device is made to couple with the connected bottles in a streamline and readily detachable manner. It should be understood that by "viscous fluids" it is meant that a myriad of substances are addresses by this application under this term whereby each having the characteristic of a slow moving fluid, examples of which are as follows: ketsup, barbecue, sauces, glazings, toppings such as, chocolate fudge or butterscotch, salad dressings, liquid food groups such as, honey, syrup, sauces, mustard and cocktail sauces, no food products such as shampoo, cream rinse, gels, lotions, hand cream, motor oil, brake fluid, antifreeze, automotive care products such as waxes, etc., cleaning products such as liquid detergent and spot removers, liquid soap.

The problem which exists in salvaging slow flowing material, such as catsup or oil, in the partially or almost completely used container is that the time it takes to drip from the nearly expended container to the one in which the food material is to be collected is quite a lengthy period. In addition, it is desirable to use a device which acts only between the interior surfaces of the containers thereby eliminating the movement of food material, for example, from around the threaded neck areas of the containers.

Coupling devices for draining one bottle of viscous fluid into another are known. Such devices are disclosed, for example, in the following patents.

U.S. Pat. No. 3,877,499 issued to Fulster on Apr. 15, 1995.

U.S. Pat. No. 3,963,063 issued to Pacarella on Jun. 15, 1976.

U.S. Pat. No. 3,620,267 issued to Seabolm on Nov. 16, 1971.

Such coupling devices are useful in the prevention of waste of the food material within the partially or almost fully used container. However, as is apparent from the above listed patents, coupling devices for transferring viscous fluids, such as found in a partially filled ketsup bottle, are known. But, one problem associated with such devices is apparent from U.S. Pat. No. 3,877,499. The device disclosed therein is seated outside the neck of the lowermost bottle which can become problematic in that the food material which normally builds up around the neck of the bottle, may come into contact with the transfer device as it is placed down over the neck of the bottle. In addition, as it drains, flowing material from the upper draining bottle might seep between the interface of the lower bottle neck and the connection device.

Accordingly, it is an object of the invention to provide a fluid transfer device which is capable of being readily inserted into two containers for gravity feeding of viscous fluid between one container and the other.

It is yet a further object of the invention to provide a fluid transfer device of the aforementioned type which acts only between the interior surfaces of the container It is yet a further object of the invention to provide a fluid transfer device of the aforementioned type which uses no threaded connections.

It is still a further object of the invention to provide a fluid transfer device of the aforementioned type wherein the device is capable of being made in a single unitary piece.

SUMMARY OF THE INVENTION

The invention resides in fluid transfer device having an inverted funnel at its top and a conically downwardly tapered funnel at its bottom with a collecting portion formed about generally its midspan. The upper inverted funnel has a longitudinal slot formed therewithin and an opening is formed in the collecting portion allowing fluid to pass between the upper container and the lowermost container and the slot allows the upper inverted funnel to be circumferentially compressed against the interior surface of a container so as to act as a fluid conduit therebetween.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT

Figure 1A:
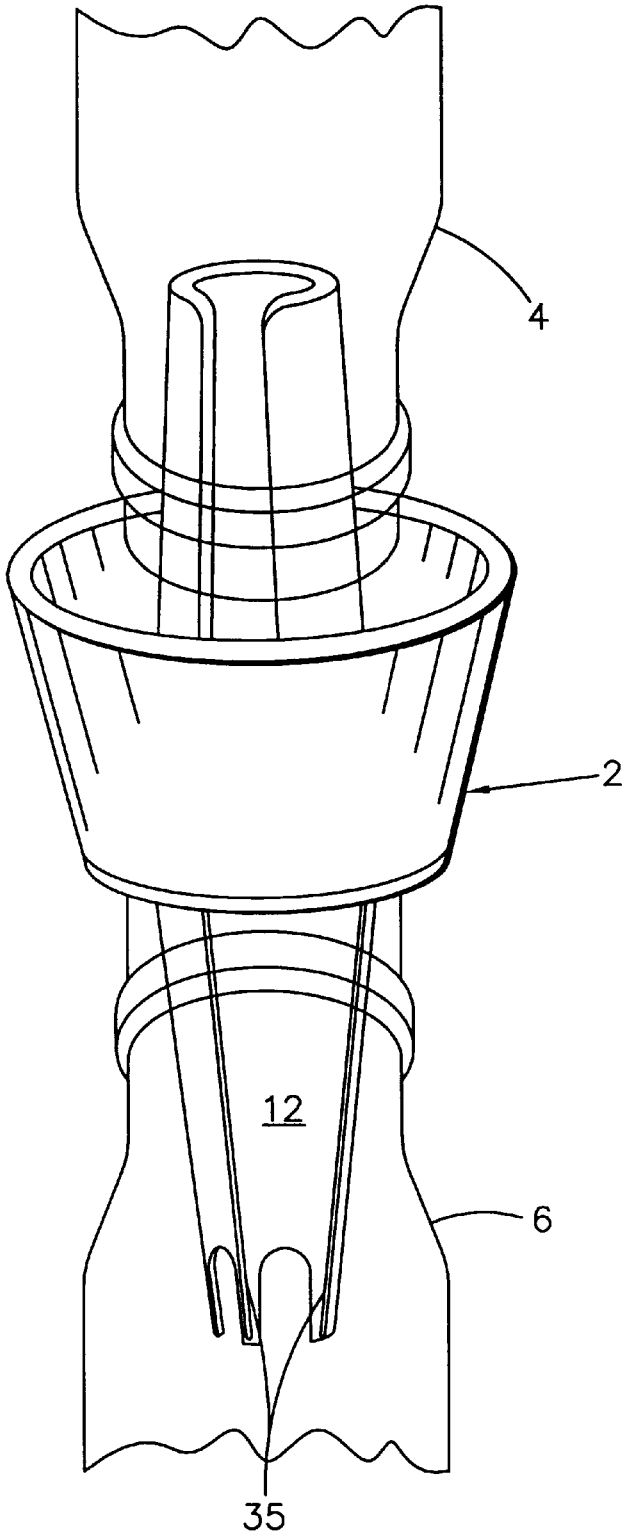
FIG. 1*a* is a first perspective view of the fluid transfer device shown in its connecting mode between two containers.
Figure 1B:
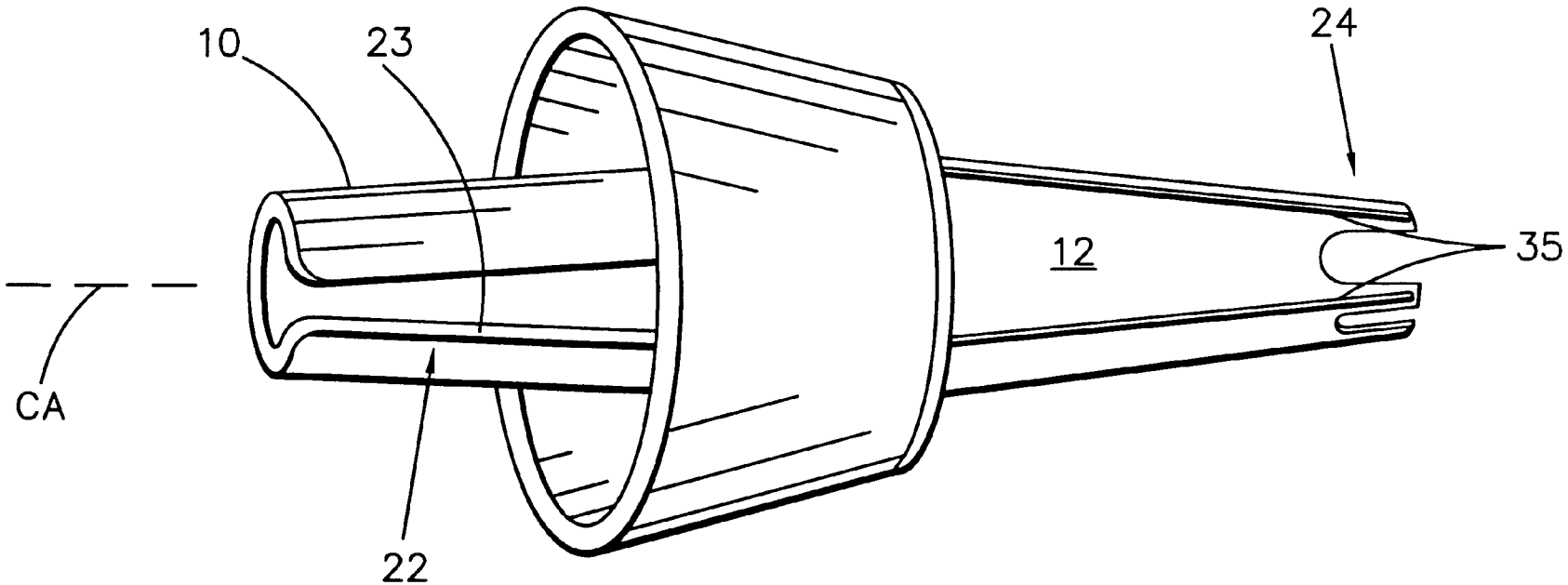
FIG. 1*b* is a perspective view of the fluid transfer device shown in FIG. 1 without the two containers.
Figure 6:
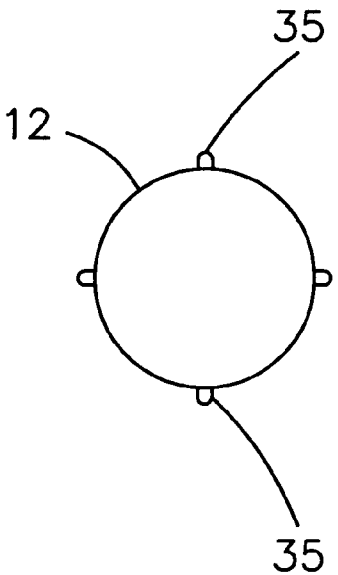
FIG. 6 is a view taken along line 6—6 in FIG. 3.
Figure 2:
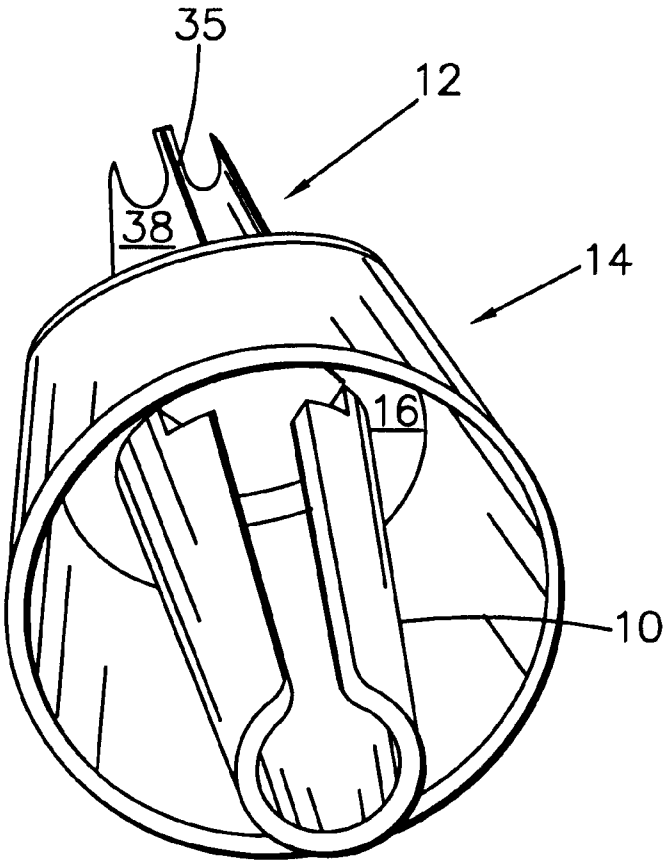
FIG. 2 is a second perspective view of the fluid transfer device shown at a second angle.

Referring now to FIG. 1*a* it should be seen that a device indicated generally as numeral 2 is shown in the preferred embodiment. The device 2 is adapted to be readily connected between an inverted container 4 and an upright container 6. The inverted container may contain food material, such as ketsup, or other like viscous material which requires time in which to move downwardly through the device 2 and into the upright container 6 where it is collected for further use. With time, the material in the container 6 will be used to the point where the foodstuff in the container 6 will become so limited that it will itself need to be inverted over and allowed to drip into another container disposed below it.

Referring now to FIGS. 1*b*–6, it should be seen that the fluid transfer device 2 has a top inverted funnel portion 10 and a lower downwardly tapered funnel portion 12 connected with one another through a collecting portion 14 interposed therebetween.

The collecting portion 14 is integrally formed with the top inverted funnel portion 10 and includes a circumferentially disposed annular base plate 16 having a through opening 18 formed therein which communicates with each of the upper and lower tapered funnel portions 10 and 12. In the preferred embodiment, the upper and lower funnel portions 10 and 12 are made from like materials, such as, polypropylene, and the lower flange portion 12 has an integrally formed top annular flange 12' which is uniformly connected to the undersurface of the collecting portion 14 by an ultrasonic weld connection to give the device 2 a generally integral form.

The annularly disposed base plate has a sidewall 20 which extends upwardly from the base plate 16 and is preferably radially angled outwardly from the central axis CA at an angle A' equaling approximately 20° thereto. The angular disposition of the sidewall 20 is further effective in collecting the material dripping from the upper container 4 into the collecting portion 14.

It is a further feature of the invention to provide a fluid transfer device of the type disclosed herein which is capable of fluidic connection with the upper inverted container 4 and the lower upright collecting container 6 without the need of a threaded connection or other intricate connecting structure.

Accordingly, it should be seen that the inverted upper funnel portion 10 and the lower downwardly tapered funnel portion 12 each has a means 22 and 24, respectively, for quick connect insertion into a respective one of the containers 4 and 6. In the case of the upper tapered funnel portion 12, the means 22 includes a slot 23 having a median width of about 0.375 inch formed therein extending longitudinally parallel to the central axis CA of the device. The slot 23 allows the upper funnel portion 12 to be radially compliant so as to be releasably attached to the upper container 4. In this way, the device 2 is connectable to the upper container 4 such that upon insertion of the upper funnel portion 12 of the fluid transfer device 2 into the upper container 4 by axial movement through the opening in the container 4, the upper funnel portion 12 is caused to be circumferentially compressed and act against the interior surface of the container so as to act as a fluid conduit therebetween.

Figure 4:
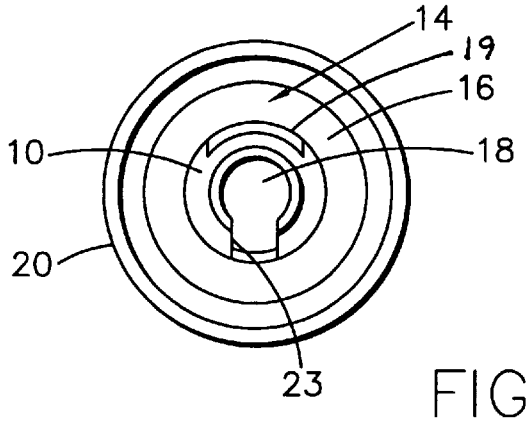
FIG. 4 is a top plan view of the device shown in FIG. 3.
Figure 3:
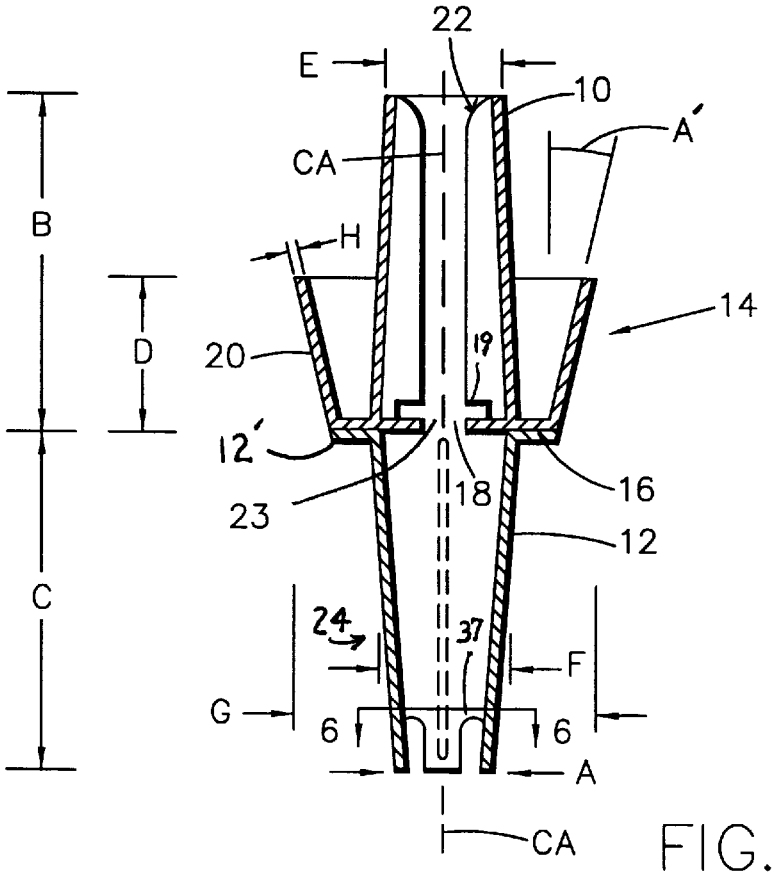
FIG. 3 is a vertical section through the device of FIGS. 1–2.
Figure 5:
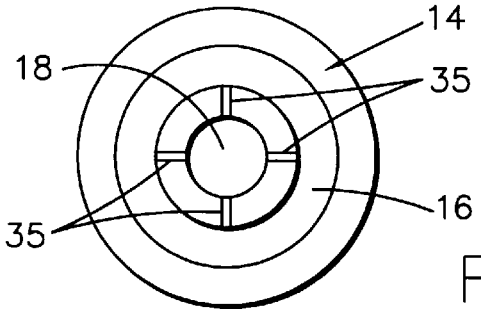
FIG. 5 is a bottom view of the device shown in FIG. 4.

The slot 23 further extends with the upper funnel portion 10 longitudinally with the axis CA so as to communicate with the central opening 18 in the base plate 16 of the collecting portion. As seen in FIG. 4, the slot 23 further extends through the base plate 16 radially outwardly from the central axis CA so as to allow material which may flow through the slot 23 from the upper funnel portion 10 and collect in the collection portion 14, to pass through the base plate 16 and down into the lower funnel portion 12 and then desirably, into the upright lower collecting container 6. To enhance the flow of fluid from the collecting portion 14 into the opening 18, opposed rectangular slots 19,19 are formed in the base of the upper funnel portion 10. The slots 19,19 have a horizontal or long dimension equal to about 0.575 inch and a height or short dimension equal to about 0.155 inch.

The lower downwardly tapered funnel portion 12 includes the means 24 for quick connect insertion into the collecting container 6. This means is defined by the downwardly tapered configuration of the lower inverted funnel portion 12 which is correspondingly sized and shaped to be wedged into the opened top of the lower container 6. To assist in this function, the outer surface 38 of the lower tapered funnel portion 12 has four longitudinally extending ribs 35,35 which are integrally formed therewith and extend radially outwardly of the central axis CA Each of the ribs 35,35 is generally circular in shape and has a diameter of about 0.065 inch. In this way, each of the inverted funnel portion 10 and the lower funnel portion 12 is capable of circumferentially holding and securing a releasable connection between the involved one of the two containers 4 and 6. At the base of the lower funnel portion 12 is provided a plurality of arc-shaped cutouts 37,37 which are provided to better increase the flow of fluid material from the lower funnel portion 12 and into the collecting container 6 and to also allow the lower funnel portion to be fit within smaller necked containers. Each of the arc-shaped cutouts has a width of about 0.235 inch and extends axially into the lower funnel portion a length equal to about 0.360 inch.

The device 2 is formed from a semi-rigid plastic material, such as polypropylene or the like and is molded. In the preferred embodiment of the invention, the polypropylene material used is injection molding grade FDA approved polypropylene with a flexural modulus of 152,00 psi and a tensile strength yield of 4030 psi, and is sold under name Epsilon Polypropylene E-5135C by Epsilon Products Co., P.O. Box 432, Post Road and Blueball Ave., Marcus Hook Pa. 19051.

Also, while not limited to the following dimensions, the device in one embodiment may have the dimensions which correspond, for example, with an application for use in catsup bottles. The reference letters below are those corresponding to those shown in FIG. 3 and are in inches.

A=0.55
B=2.25
C=2.25
D=1.0
E=0.650
F=1.0
G=2.0
H=0.070

From the foregoing, an improved fluidic transfer device has been described by way of the preferred embodiment. However numerous modifications and substitutions may be had without departing from the spirit of the invention. For example, while it is disclosed that the sidewall of the collecting portion is angled somewhat outwardly from the central axis, it is nevertheless within the purview of the invention to provide a sidewall which extends parallel to the central axis CA of the device rather than being angled outwardly. Also, the device 2 could be integrally molded as a single unitary piece.

Accordingly, the invention has been described by way of illustration rather than limitation.

What is claimed is:

1. A material transfer device comprising:

a first funnel member having an inverted shape tapering outwardly along a central axis from a top end thereof to a base end;

a second funnel member tapering inwardly along said central axis from a base end to a lower depending end;

a collecting portion connected with the first and second funnel portions at the bases thereof;

said first funnel portion having a means for causing it to be circumferentially displaceable so as to exert a radial bias against the inner surface of a first container in which the first funnel portion is inserted, and said second funnel member having a means for wedging it into an opening in a second container which is disposed uptight.

2. A device as defined in claim 1 further characterized by said means in said first funnel portion being a longitudinally extending slot extending parallel with the central axis of the device.

3. A device as defined in claim 2 further characterized by said device formed as an integrally formed semirigid plastic member.

4. A device as defined in claim 3 further characterized by said collecting portion having an annular base plate extending circumferentially about a through opening connecting each of said first and second funnel members with one another.

5. A device as defined in claim 4 further characterized by said collecting portion having an annular sidewall which extends upwardly towards said first funnel portion.

6. A device as defined in claim 5 further characterized by said sidewall extending at an angle outwardly from said collecting portion and of said central axis.

7. A device as in defined in claim 6 further characterized by said lower funnel portion having at least one longitudinally extending rib extending parallel with said central axis.

8. A device as defined in claim 7 further characterized by said slot formed in said first funnel portion communicates with said central opening in said base plate.

9. A device as defined in claim 4 further characterized by said base plate having said slot formed in it and extending radially outwardly of said central axis.

10. A fluidic transfer device having a central axis comprising:

a inverted top funnel portion defined by a tip and a base, said base having a wider diameter than the diameter of said tip;

a lower funnel portion defined by a base and a tip with the base of the lower funnel portion being wider than the lower funnel portion at said tip thereof;

a collecting portion disposed annularly about said central axis and defined by a base plate extending transversely to the central axis and having a through opening communicating with each of said upper and lower funnel members; and wherein said upper and lower funnel portions are connected to said base plate at the bases thereof.

11. A device as defined in claim 10 further characterized by said upper funnel portion having a longitudinally extending slot extending from said tip thereof to said base thereof and parallel to the central axis so as to cause said upper funnel portion to be circumferentially compliant when inserted axially into the opening of a container.

12. A device as defined in claim 10 further characterized by said upper funnel portion having a longitudinally extending slot extending from said tip thereof to said base thereof and parallel to the central axis so as to cause said upper funnel member to be circumferentially compliant when inserted axially into the opening of a container, and said slot extending into said base plate to extend radially from said central axis.

13. A device as defined in claim 12 further characterized by said collecting portion having an annularly extending sidewall opening towards upper funnel portion.

14. A device as defined in claim 10 further characterized by said collecting portion having an annularly extending sidewall opening towards the upper funnel portion.

15. A device as defined in claim 14 further characterized by said member being formed from a semi-rigid plastic.

16. A device as defined in claim 15 further characterized by said semi-rigid plastic is polypropylene.

17. A device as defined in claim 10 further characterized by said lower funnel portion at said tip having a plurality of arc-shaped cutouts extending axially into the lower funnel portion from the tip thereof.

* * * * *